US007588341B2

(12) United States Patent
Lin

(10) Patent No.: US 7,588,341 B2
(45) Date of Patent: Sep. 15, 2009

(54) ILLUMINATIVE JACK

(75) Inventor: Lai-Shun Lin, Chia-Yi Hsien (TW)

(73) Assignee: Kai Hsiang Enterprise Co Ltd., Cha-Yi Hsien (TW)

( * ) Notice: Subject to any disclaimer, the term of this patent is extended or adjusted under 35 U.S.C. 154(b) by 0 days.

(21) Appl. No.: 11/609,426

(22) Filed: Dec. 12, 2006

(65) Prior Publication Data

US 2008/0137338 A1 Jun. 12, 2008

(51) Int. Cl.
*B25B 23/18* (2006.01)
*F21V 33/00* (2006.01)
*B66F 7/26* (2006.01)

(52) U.S. Cl. ..... 362/119; 362/109; 254/45

(58) Field of Classification Search ..... 362/119, 362/109; 254/45–50
See application file for complete search history.

(56) References Cited

U.S. PATENT DOCUMENTS 4,018,421 A 4/1977 Tallman
4,872,230 A 10/1989 Levine
D332,337 S 1/1993 Wang
5,992,826 A 11/1999 Simmonds
6,357,724 B1 * 3/2002 Hung ..... 254/8 B
6,375,160 B1 * 4/2002 Hung ..... 254/8 B
6,642,667 B2 * 11/2003 Avis ..... 315/200 A
6,848,673 B1 * 2/2005 McLaughlin et al. ..... 254/8 B
6,910,677 B1 * 6/2005 Miller et al. ..... 254/126
7,163,312 B2 * 1/2007 Woodyard ..... 362/183
7,207,548 B1 * 4/2007 Howe ..... 254/98
7,309,140 B2 * 12/2007 Huang ..... 362/191
2003/0043581 A1 * 3/2003 Finnigan ..... 362/253
2008/0013317 A1 * 1/2008 Hinds ..... 362/286

OTHER PUBLICATIONS

AC Delco flyer. 1999.

* cited by examiner

*Primary Examiner*—Jong-Suk (James) Lee
*Assistant Examiner*—David J Makiya
(74) *Attorney, Agent, or Firm*—Tsircou Law, P.C.

(57) ABSTRACT

An illuminative jack includes a lighting device disposed in a top plate and connected to a switch. When the user switches on the switch, the lighting device will be radiated by the power supplied by a power source, thus providing an illumination effect.

20 Claims, 5 Drawing Sheets

ILLUMINATIVE JACK

BACKGROUND OF THE INVENTION

1. Field of the Invention

The present invention relates to an illuminative jack including a lighting device disposed in a top plate of the jack, with the lighting device powered by a power source and controlled by a switch. Therefore, when the user switches on the switch, the lighting device will be radiated to illuminate a lifting object.

2. Description of the Prior Art

A jack is a device for lifting a heavy object and has the properties of easy movement and operation. Thus, the jack is widely used in various industries, and particularly in vehicle maintenance. Therefore, almost every vehicle has a need for a jack.

Since the jack is used for lifting a heavy object, in operation, the jack must be pushed to the bottom of the heavy object, such that the jack will be shaded by the shadow of the heavy object. Where there is insufficient light, particularly at night, the user may be unable to determine the position of a top plate of the jack. To solve this problem, the user has to adjust the position of the jack by by pushing it with one hand and to grip a lighting device by the other hand to illuminate the position between the jack and the bottom of the heavy object, which is inconvenient to the user. Moreover, the user may have no lighting device to use, so the conventional jack cannot meet the users' requirement.

The present invention has arisen to mitigate and/or obviate the afore-described disadvantages.

SUMMARY OF THE INVENTION

The primary objective of the present invention is to provide an illuminative jack including a lighting device disposed in a top plate and connected to a switch. When the user switches on the switch, the lighting device will be radiated by the power supplied by a power source.

Since the lighting device is disposed in the top plate of the jack, in operation, the lighting device will be radiated by switching on the switch. When the user pushes the jack to the bottom of a heavy object, the bottom of the heavy object can be illuminated adequately. Thus, the user can see the position of the jack opposite to the bottom of the heavy object clearly to determine the distance and the position between the top plate and the lifted heavy object (since the top plate is in contact with the object directly, the lighting device disposed in the top plate has better illumination effect), and to prevent the jack from being affected by insufficient light (a dark area in particular). Moreover, the lighting device is disposed in the top plate, so the function of the top plate will not be hindered, making the present jack easy to operate and practical.

The present invention will become more obvious from the following description when taken in connection with the accompanying drawings, which show, for purpose of illustration only, the preferred embodiments in accordance with the present invention.

DETAILED DESCRIPTION OF THE PREFERRED EMBODIMENTS

Figure 1:
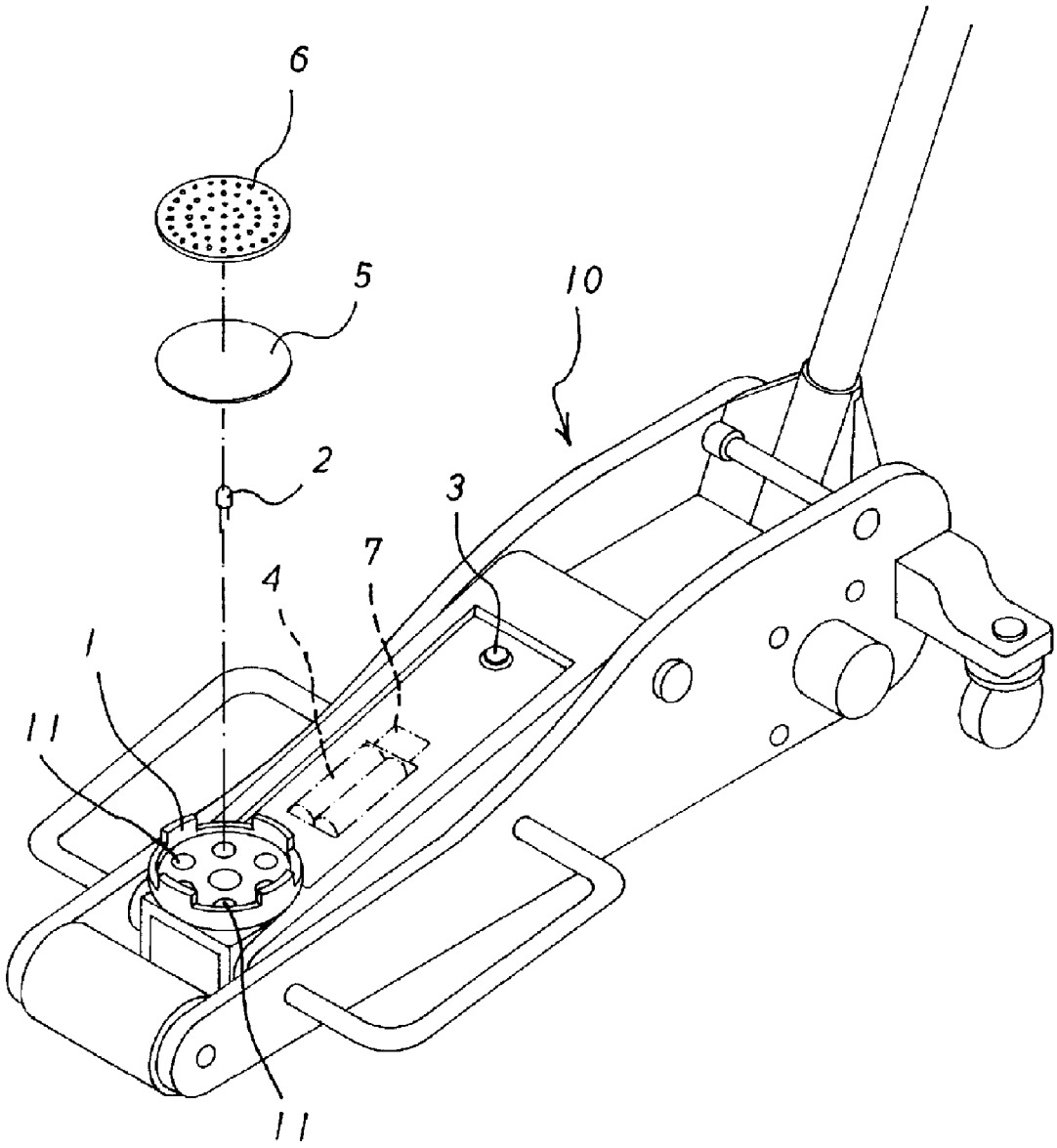
FIG. 1 is a partially exploded view of an illuminative jack in accordance with the present invention.

Referring to FIG. 1, an illuminative jack 10 in accordance with the present invention comprises a lighting device 2 disposed in atop plate 1 of the jack 10. The lighting device 2 is controlled by a switch 3 and is connected to a power source 4 (as shown in FIG. 1, the lighting device can be a bulb, LED or other luminaries). When the user switches on the switch 3, the lighting device 2 will be radiated by the power supplied by the power source 4, thus providing an illumination effect.

Figure 2:
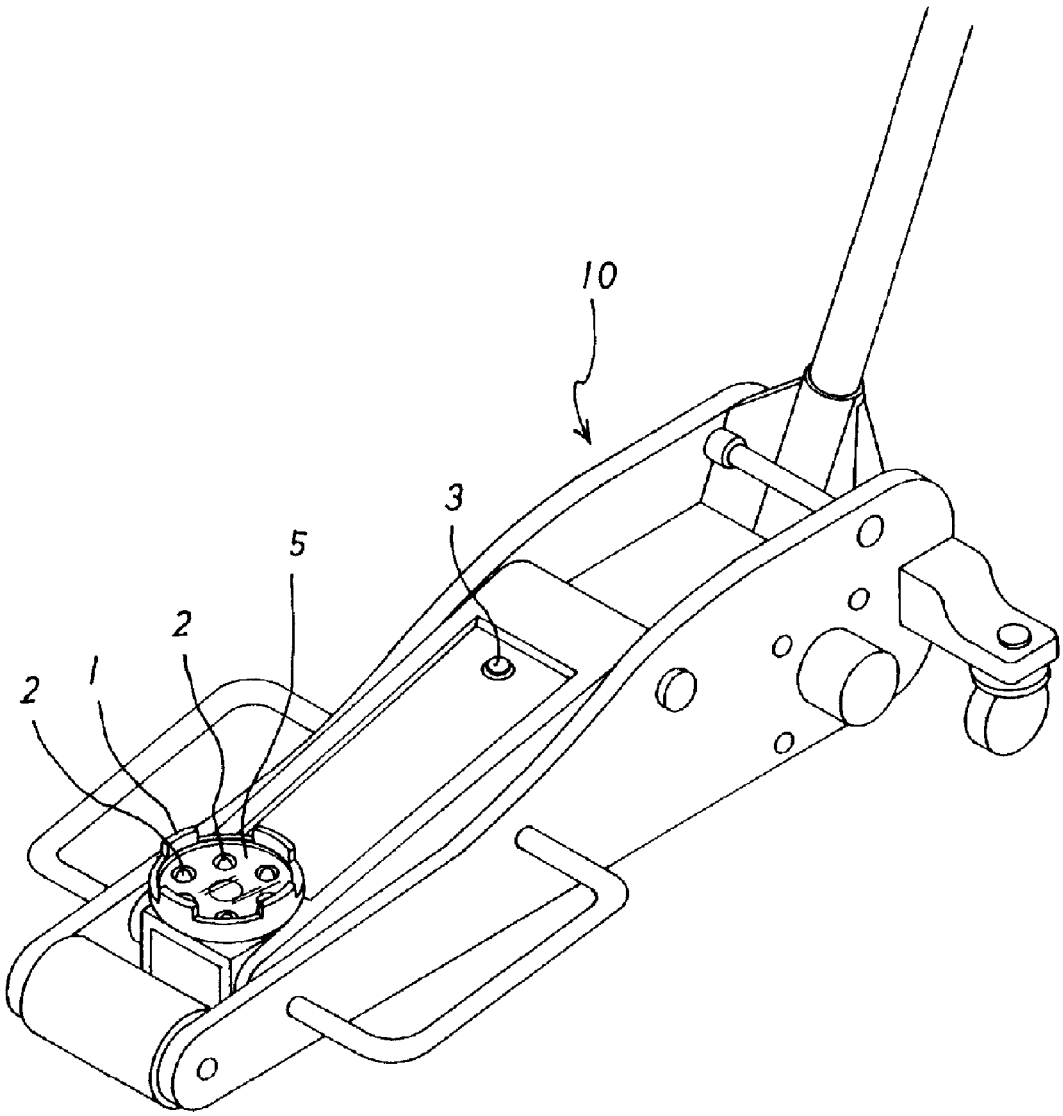
FIG. 2 is a perspective view of the illuminative jack in accordance with the present invention.
Figure 3:
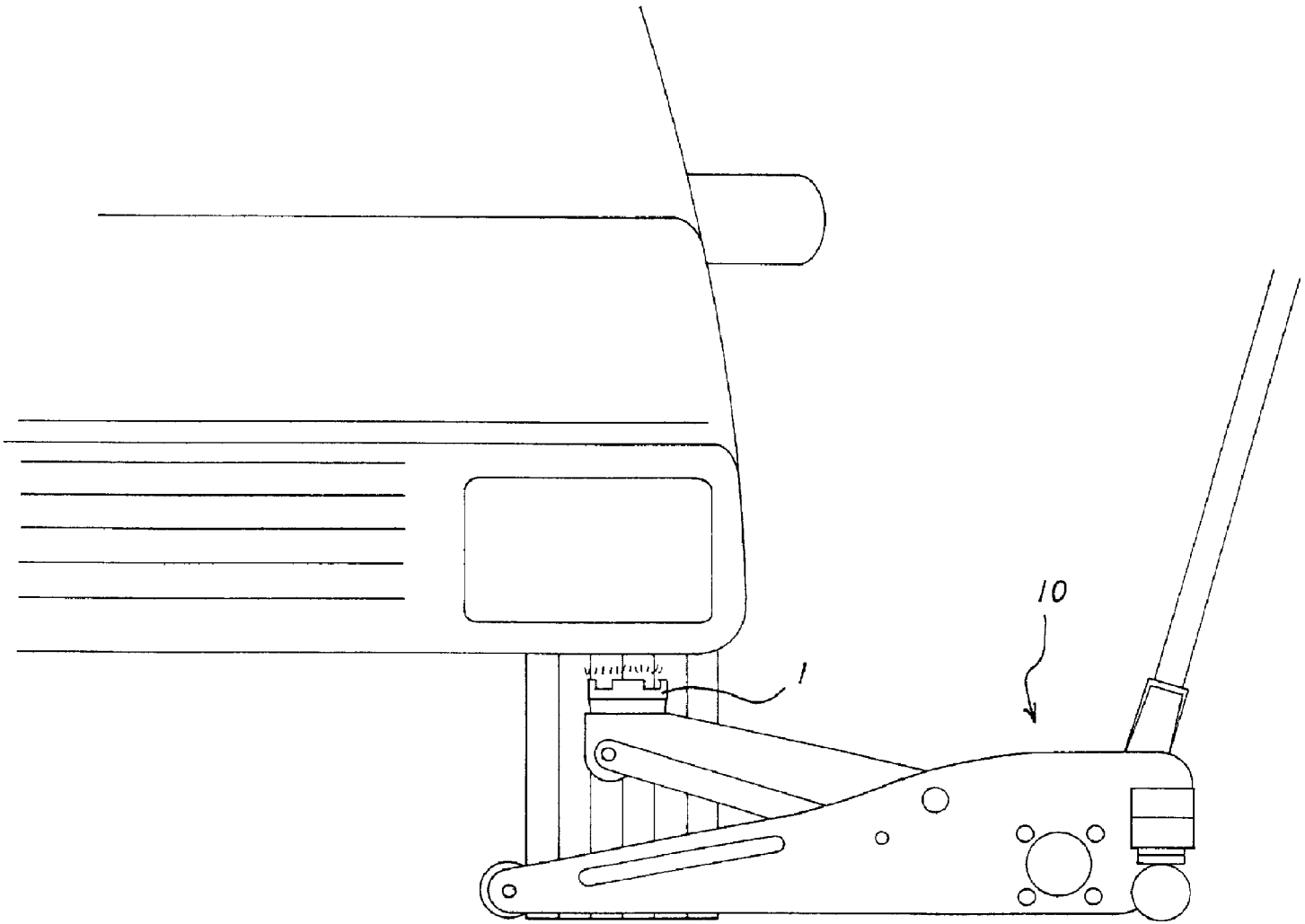
FIG. 3 is an illustrative plan view of the illuminative jack in accordance with the present invention.

When the jack 10 of the present invention has an illumination effect (as shown in FIG. 2), the user can switch on the lighting device 2 via the switch 3 under a dark area according to the actual requirements (as shown in FIG. 3) to illuminate the bottom of a heavy object being lifted directly, thus solving the problem of insufficient light. Thereby, the user needn't grip a lighting device by the other hand, and the heavy object can be illuminated by adjusting the position of the jack 10 directly. Thus, the present invention is easy to operate.

Figure 4:
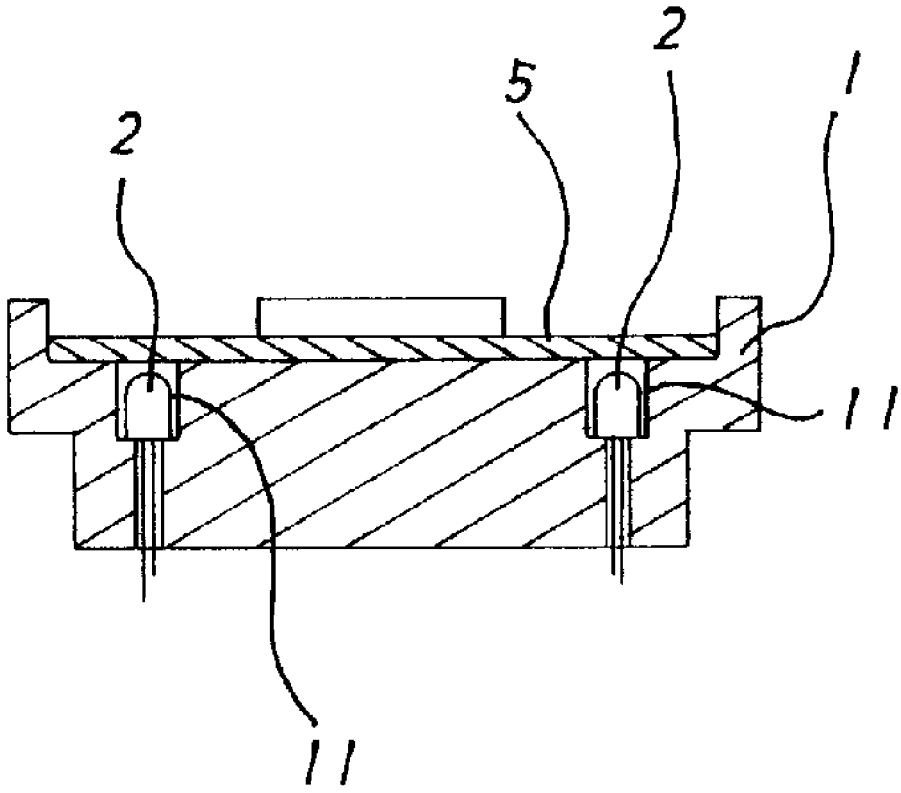
FIG. 4 is a cross sectional view of a top plate of the illuminative jack in accordance with the present invention.

In addition, the top plate 1 of the jack 10 is defined with a plurality of receiving grooves 11 (as shown in FIG. 4) for receiving the lighting device 2, and a transparent cover 5 is provided for protecting the lighting device 2.

Further, a pad 6 is covered on an upper portion of the transparent cover 5 to prevent the transparent cover 5 from being abraded when the lighting device 2 is not in use.

The switch 3 of the present invention can be connected to a timer 7 so that when the user switches on the switch 3, the output power of the power source 4 can be cut off automatically after a scheduled time (such as three minutes), thus, preventing the waste of the power when the user forgets to switch off the switch 3.

Figure 5:
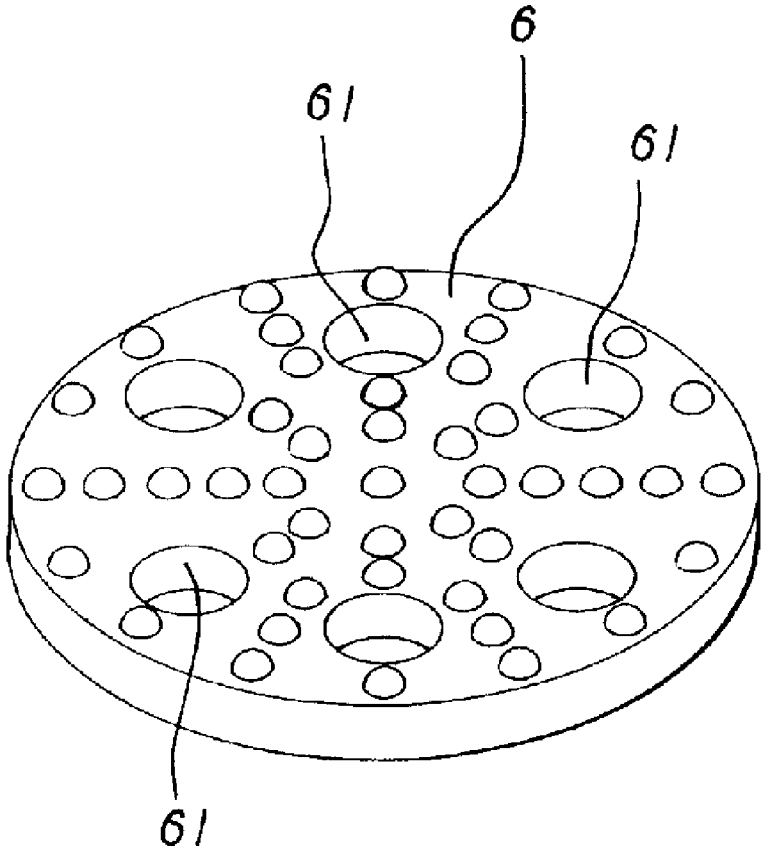
FIG. 5 is a perspective view of a pad of the illuminative jack in accordance with the present invention.

The pad 6 can be defined with a plurality of through holes 61 located correspondingly to the lighting device 2 of the top plate 1 (as shown in FIG. 5), so as to illuminate the lifting object directly.

While various embodiments in accordance with the present invention have been shown and described, it should be clear to those skilled in the art that further embodiments may be made without departing from the scope of the present invention.

What is claimed is:

1. An illuminative jack, comprising:

a pair of elongated side walls in spaced relationship from one another, each side wall having a front portion, an intermediate region, and an end portion;

a lift arm having a first end pivotally coupled to the intermediate regions of the side walls and a second end proximate to the front portions;

a top plate coupled to the second end of the lift arm, the top plate configured to engage a lifting location of an object to be lifted;

a light source disposed atop a central region of the top plate to provide illumination directed to the lifting location;

a pad disposed atop a central region of the top plate, the pad having an upper surface positioned to contact the lifting location when in use, the pad defining a through hole aligned with the light source to enable light to emanate onto the lifting location; and a transparent material positioned above the light source and disposed below the upper surface of the pad, the transparent material aligned to substantially cover the through hole of the pad to protect the light source, while allowing light to emanate on the lifting location.

2. An illuminative jack as set forth in claim 1, wherein the top plate includes an upstanding ridge about the periphery thereof, and the pad includes an outer edge configured to be proximate to the upstanding ridge about the circumference thereof.

3. An illuminative jack as set forth in claim 2, wherein the transparent material is configured as a single transparent cover disposed over the central region of the top plate covering the light source.

4. An illuminative jack as set forth in claim 1, wherein the transparent material is configured as a single transparent cover disposed over the central region of the top plate covering the light source.

5. An illuminative jack as set forth in claim 4, wherein the single transparent cover includes an outer edge configured to be proximate to an upstanding ridge about the circumference thereof.

6. An illuminative jack as set forth in claim 4, wherein the top plate includes an upstanding ridge about the periphery thereof, and the pad includes an outer edge configured to be proximate to the upstanding ridge about the circumference thereof.

7. An illuminative jack as set forth in claim 1, wherein:

the top plate includes a peripheral edge and defines a groove for receiving the light source such that the light source is disposed below an upper surface of the top plate;

the pad includes an outer edge configured to be proximate to the peripheral edge of the top plate about the circumference thereof; and the transparent material is configured as a single transparent cover disposed over the central region of the top plate covering the light source, the transparent cover having an upper surface disposed below the upper surface of the pad.

8. An illuminative jack, comprising:

a pair of elongated side walls in spaced relationship from one another, each side wall having a front portion, an intermediate region, and an end portion;

a lift arm having a first end pivotally coupled to the intermediate regions of the side walls and a second end proximate to the front portions;

a top plate coupled to the second end of the lift arm, the top plate configured to engage a lifting location of an object to be lifted; and a plurality of lights disposed in a central region of the top plate such that the lights are positioned to provide illumination directed to the lifting location, when in use, the illuminative jack further comprising a pad disposed atop the central region of the top plate, the pad having an upper surface positioned to contact the lifting location when in use, the pad defining at least one through hole positioned to enable light from the plurality of lights to emanate onto the lifting location.

9. An illuminative jack as set forth in claim 8, further comprising transparent material positioned above the plurality of lights and disposed below the upper surface of the pad, the transparent material aligned to protect at least one light of the plurality of lights, while allowing light to emanate on the lifting location.

10. An illuminative jack as set forth in claim 8, wherein the pad includes an outer edge configured to be proximate to an outer edge of the top plate about the circumference thereof.

11. An illuminative jack as set forth in claim 10, wherein the transparent material includes an outer edge configured to be proximate to the outer edge of the top plate about the circumference thereof.

12. An illuminative jack as set forth in claim 10, wherein the pad defines a plurality of through holes aligned with the plurality of lights.

13. An illuminative jack as set forth in claim 12, wherein the transparent material is configured as a single transparent cover sandwiched between the pad and an upper surface of the top plate.

14. An illuminative jack as set forth in claim 13, wherein the transparent cover includes an outer edge configured to be proximate to the outer edge of the top plate about the circumference thereof.

15. An illuminative jack, comprising:

a pair of elongated side walls in spaced relationship from one another, each side wall having a front portion, an intermediate region, and an end portion;

a lift arm disposed between the side walls, the lift arm having a first end pivotally coupled to the intermediate regions of the side walls and a second end proximate to the front portions;

a top plate coupled to the second end of the lift arm, the top plate configured to engage a lifting location of an object to be lifted, the top plate defining a plurality of grooves spaced about a central region of the top plate;

a plurality of lights, each light received within a corresponding groove of the plurality of grooves of the top plate such that the lights are positioned provide illumination directed to the lifting location, when in use;

a transparent cover disposed atop the central region of the top plate covering the plurality of lights; and a pad disposed over the transparent cover such that the transparent cover is sandwiched between the pad and an upper surface of the top plate, the pad defining a plurality of through holes aligned with the plurality of lights, the pad having an upper surface positioned to contact the lifting location when in use.

16. An illuminative jack as set forth in claim 15, wherein the pad includes an outer edge configured to be proximate to an outer edge of the top plate about the circumference thereof.

17. An illuminative jack as set forth in claim 16, wherein the transparent cover includes an outer edge configured to be proximate to the outer edge of the top plate about the circumference thereof.

18. An illuminative jack as set forth in claim 15, further comprising a switch configured to control the plurality of lights.

19. An illuminative jack as set forth in claim 18, wherein the switch is disposed on the lifting arm and the switch is connected to a timer that switches the plurality of lights off after a prescribed time.

20. An illuminative jack as set forth in claim 15, wherein the plurality of lights includes six lights, each light received within a corresponding groove of the plurality of grooves of the top plate.

* * * * *